US005810566A

United States Patent [19]

Pauwels

[11] Patent Number: 5,810,566

[45] Date of Patent: Sep. 22, 1998

[54] PULSE DAMPER OR ACOUSTIC OUTLET PIECE FOR A COMPRESSOR AND COMPRESSOR EQUIPPED THEREWITH

[75] Inventor: Raphaël Pauwels, Bornem, Belgium

[73] Assignee: Atlas Copco Airpower, Wilrijk, Belgium

[21] Appl. No.: 746,767

[22] Filed: Nov. 15, 1996

[30] Foreign Application Priority Data

Nov. 16, 1995 [BE] Belgium ..... 09500943

[51] Int. Cl.[6] ..... F04B 11/00

[52] U.S. Cl. ..... 417/312; 451/540; 181/252

[58] Field of Search ..... 417/312, 540; 181/229, 252, 256

[56] References Cited

U.S. PATENT DOCUMENTS

| | | | |
|---|---|---|---|
| 1,844,105 | 2/1932 | Schnell | 181/252 |
| 1,844,106 | 2/1932 | Schnell | 181/252 |
| 1,927,213 | 9/1933 | MacKenzie et al. | 417/312 |
| 3,175,640 | 3/1965 | Matsui | 181/55 |
| 3,495,950 | 2/1970 | Barber et al. | 181/252 |
| 3,602,333 | 8/1971 | Kobayashi et al. | 181/42 |
| 4,211,303 | 7/1980 | Matthews et al. | 181/248 |
| 5,137,439 | 8/1992 | Lundin | 417/312 |
| 5,419,126 | 5/1995 | Kiyooka | 60/299 |

FOREIGN PATENT DOCUMENTS

| | | |
|---|---|---|
| 361081 | 6/1929 | Belgium . |
| 0 037 559 | 10/1981 | European Pat. Off. . |
| 2 681 905 | 4/1993 | France . |

*Primary Examiner*—Charles G. Freay
*Attorney, Agent, or Firm*—Bacon & Thomas

[57] ABSTRACT

Outlet piece for a compressor, which outlet piece contains a damping body (3) applied symmetrically around a passage (2), wherein the passage has a constant diameter and in that the damping body (3) has a transverse dimension which gradually increases along the direction of flow (V), so that this damping body (3) has a transverse thickness which increases along the direction of flow (V).

13 Claims, 1 Drawing Sheet

PULSE DAMPER OR ACOUSTIC OUTLET PIECE FOR A COMPRESSOR AND COMPRESSOR EQUIPPED THEREWITH

BACKGROUND OF THE INVENTION a) Field of the Invention

The present invention concerns a pulse damper or acoustic outlet piece (muffler) for a compressor, as well as a compressor equipped therewith.

b) Discussion of Related Art

It is known that in the outlet volume of compressors, and in particular of compressors of the displacement type, including screw-type compressors, considerable compression or pressure pulses occur.

For various reasons, it is advisable that these compression pulses be damped or muffled.

A first reason is that the vibrations in internal components, such as temperature and pressure sensors, and in the conduits of the cooler which are usually used, must be restricted so as to prevent the components from being damaged.

A second reason is that undamped compression pulses cause impermissible sound emissions, both of the compressor itself and of the conduits and appliances which are connected to the outlet of the compressor.

Until now, these compression pulses were damped by means of an acoustic outlet piece or muffler which is configured as a quarter wavelength resonator. These known outlet pieces of the resonator type are dimensioned such that they reflect sound waves in the direction of the source, in such a way that damping occurs. As the outlet sound of a screw-type compressor is characterized by powerful, pure tones, a very good deadening of sound can thus be obtained by exactly adjusting the geometry of such an outlet piece to the quarter wave length of the above-mentioned pure tones.

Outlet pieces of the resonator type mainly deaden sound which travels as longitudinal waves.

In order to obtain an effective deadening, the dimensions of the outlet piece must be precisely adjusted to the compressor. Hence, every different application requires an outlet piece with different dimensions.

Outlet pieces of the resonator type exclusively provide for a deadening of sound in the shape of longitudinal, flat waves.

Moreover, with a correctly adjusted outlet piece of the resonator type, an accumulation of pulse energy may arise, which results in that structural adjustments have to be made to the compressor and/or the resonator for certain applications so as to exclude strong vibrations which could be generated due to this accumulated pulse energy.

For a smooth service, the outlet pieces of the resonator type must be provided with sudden changes in the diameter, so that relatively large housings are often required. Mechanical reinforcements of these housings may be necessary in order to prevent a too high sound emission of these housings.

U.S. Pat. No. 3,602,333 describes a sound absorber to be mounted on a conduit for a fluid under pressure, at the location where said fluid is drawn in or released. This sound absorber contains a damping body which is erected around a conical passage which widens along the direction of flow. Said damping body is a metal plate in the shape of a conical surface which is covered with a layer of damping material of invariable thickness on the side of the passage. In the passage can also be erected a second damping body which consists of a metal plate in the shape of the surface of a truncate cone, which plate is covered on both sides with damping material.

This known sound absorber is designed for damping turbulent flows and provides for damping material wherever there is turbulence. This sound absorber is not suitable for a closed circuit under pressure, such as in the case of a compressor, and it is not optimized or designed to sufficiently suppress the reflection of waves to the inlet of the damper, which is necessary for the strong tonal frequency components of a compressor.

Belgium Patent No. 361,081 describes various embodiments of sound absorbers which are designed for combustion engines. They contain a damping body which is provided symmetrically around a passage, but none of these embodiments has a passage with an invariable diameter as well as a damping body whose perimeter and thickness increase along the direction of flow. None of these embodiments excludes sound reflections on the inlet of the damper and none of these embodiments is suitable to be mounted in a closed circuit with a compressor.

The invention aims to provide an outlet piece which does not show the above-mentioned disadvantages.

In particular, it to provide aims an outlet piece which is particularly suitable for screw-type compressors, which does not exclude its use in combination with other types of compressors, as well.

Also, it aims at providing an outlet piece which achieves deadening in a very large frequency range, in particular in the entire frequency range in which the compression pulses of a screw-type compressor normally occur, i.e. the range between 250 and 6,000 Hz.

Moreover, the invention aims to provide an outlet piece in which such materials are preferably used that the outlet piece can easily resist the high temperatures which may arise on the outlet of a screw-type compressor, which, as is known, may rise to 250° C.

Naturally, it should also be an outlet piece which, can resist the pressure felt, which as is known, may rise to 10.5 bar in a screw-type compressor.

To this end, the invention consists of an outlet piece for a compressor, consisting of a damping body applied symmetrically around a passage, whereby this passage has a constant diameter and this damping body has a perimeter (circular or polygonal) which has a transverse dimension that gradually increases in the direction of flow and thus has a thickness which increases in the direction of flow.

Thanks to the gradually increasing transverse dimension, standing waves are not generated between the outlet of the compressor an the inlet of the outlet piece.

Preferably, the transverse dimension (or diameter, if circular) gradually increases along the entire length of the pulse damper according to the invention, in other words from the inlet of the damper passage up to the outlet thereof. The transverse dimension of the inlet is preferably equal to or almost equal to the transverse dimension of the passage.

If required, the gradually widening part can be followed by a part with an equal transverse dimension so as to further increase the damping.

The damping body is hereby preferably conically shaped and has a circular cross-section oversite length for every cross-section.

The passage is preferably rectilinear and has an invariable diameter over the entire length, so that the compressed gas flowing through it experiences a minimum of flow resistance.

The outside of this damping body preferably consists of a plate-shaped (sheet material) jacket.

The space of the outlet piece surrounding the passage is preferably mainly filled with a filling of sound-absorbing material.

This filling is made of a porous material, for which use is made according to one of the preferred embodiments of a fibrous mass or fibrous material.

The above-mentioned passage can be defined or surrounded by a preferably round, tubular wall of porous and sound-transparent material. This tubular wall makes sure that the material of the above-mentioned filling does not end up in the passage and also makes sure that the passage is limited by a smooth or rather smooth wall, so that no turbulence can arise in the flow of compressed gas coming through it.

Around the above-mentioned tube wall can also be provided an air-permeable protective layer, for example in the shape of a thimble, so as to prevent fine material particles, fibres and such of the filling going through the porous tube wall and ending up in the flow of air.

According to an alternate embodiment, use is made of a filling made of a material with a solid, porous structure, such as a ceramic foam or a highly porous, sintered powder of stainless steel. This variant offers the advantage that no particles, such as for example fibres, can come loose from the filling. Also, from a constructional point of view, this offers the advantage that the above-mentioned separate tube wall and protective layer can be omitted, as they are no longer necessary. The filling may in this case be formed of a homogenous structure which defines or extends from the passage to the outer wall of the outlet piece.

The invention also concerns a compressor, among others a screw-type compressor which is equipped with an outlet piece according to the invention.

BRIEF DESCRIPTION OF THE DRAWINGS

In order to better explain the characteristics of the invention, the following preferred embodiments are described as an example only without being limitative in any way, with reference to the accompanying drawings, in which.

DETAILED DESCRIPTION

Figure 1:
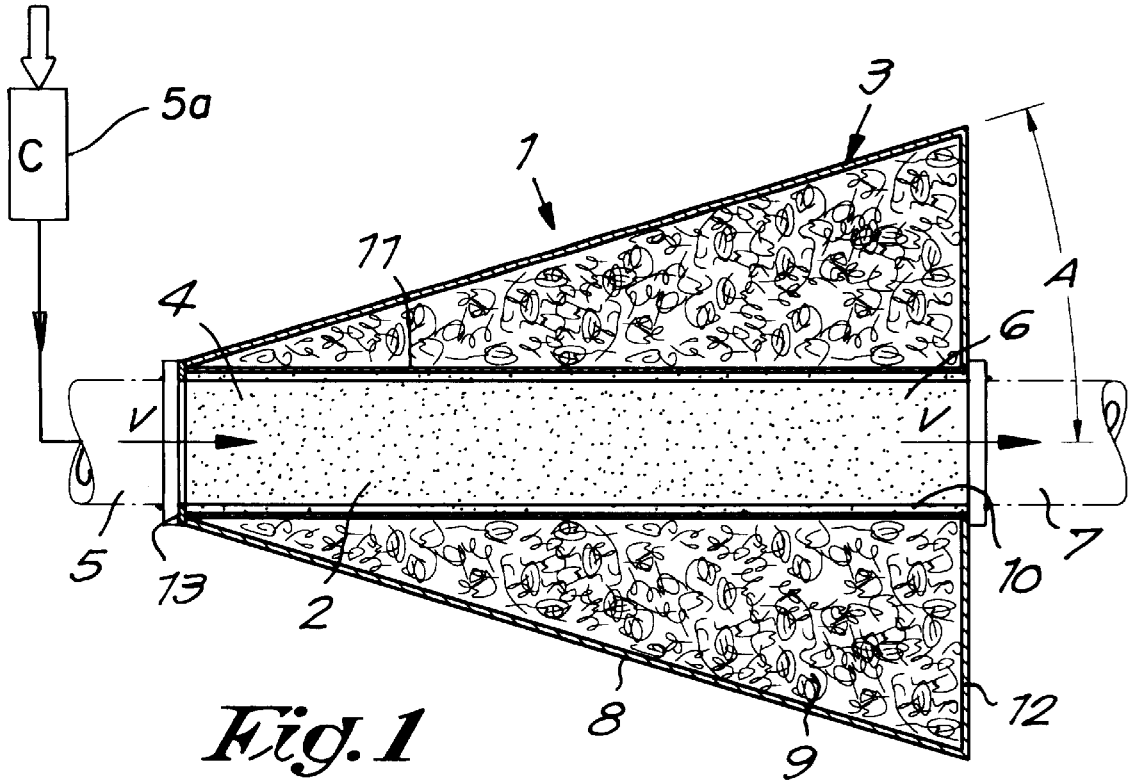
FIG. 1 shows an outlet piece according to the invention as a section.

The outlet piece 1 according to the invention mainly consists of a damping body 3 provided around a central passage 2.

The passage 2 is connected with its open inlet end 4 to the open outlet end 5 of a compressor 5*a*, and with its outlet end 6 to an inlet end 7 of an after-cooler which is part of the compressor, or to the inlet of a consumer device.

According to the invention, the damping body 3 has a diameter or transverse dimension which gradually increases in the direction of flow V and this body thus has a transverse thickness which gradually increases along the direction of flow V, preferably from the inlet end 4 to the outlet end 6.

The damping body 3 is thus tapered or cone-shaped. Preferably, near the inlet end 4, the diameter transverse dimension of this damping body 3 is equal or almost equal to the diameter of the passage 2. The conicity is preferably characterized by an angle A of 10° to 25° relative to the axis of the body 3.

The passage 2 is rectilinear and has an invariable or constant diameter around which the damping body is symmetrically provided.

The outside of the damping body 3 consists of a plate-shaped jacket 8, for example made of metal, in particular steel.

The space between the passage 2 and the jacket 8 is mainly filled with a filling 9 of sound-absorbing material which preferably consists of a fibre mass, for which one can choose for example between rock wool, glass wool, ceramic wool and steel wool made of stainless steel.

In order to prevent the filling 9 from entering the passage 2, said passage 2 is surrounded by a tube 10 made of porous and sound-transparent material which can be made among others of a material selected from the following series: filtering material with fine pores formed of woven wire mesh; sintered, non-woven wire mesh, preferably made of stainless steel; and sintered and reinforced non-woven wire mesh, preferably made of stainless steel.

The filling 9 preferably occupies the entire space between the tube 10 and the jacket 8 and is contiguous with the tube 10 and passage 2.

Around the above-mentioned tube 10 can be provided an air-permeable protective layer 11 which prevents material particles of the filling 9, such as fibres, going through the porous tube 10 and ending up in the passage 2, whereby this protective layer can be formed of a textile layer or a material layer made of a non-woven fibre material, preferably glass fibre.

In order to prevent material of the filling 9 from coming loose of the outlet piece 1, the widest end can be closed off by means of an end plate 12, so that the filling 9 is entirely contained by the jacket 8, the tube 10, the protective layer 11 respectively, and the end plate 12.

The jacket 8, as well as the end plate 12, and possible extra sealing parts 13, which can actually be part of the jacket 8, make sure that the whole is air-tight in order to exclude pressure losses.

The working of the outlet piece is as follows.

The air of the compressor is carried from the inlet end 4 to the outlet end 5 through the passage 2. As soon as the air enters the central passage, the compression pulses are damped in the filling 9 by means of absorption. Thanks to the gradually increasing diameter, this absorptive damping further increases, so that the required damping is obtained in a large frequency range.

The filling 9 hereby makes sure that the compression pulses are absorbed such that the waves which are reflected as a result of the sudden diameter decrease at the end of the outlet piece acquire a negligible amplitude.

This filling 9 can be made of a flexible or rigid porous material. Due to the incoming compression pulses, the oscillating air particles experience resistance as they go through the pores of this porous material. This leads to dissipation of energy, due to viscous effects as a result of shearing forces in the boundary layer flow at the edges of the pores on the one hand, and due to heat loss over the boundary layer on the other hand. This viscous/thermal process of energy dissipation, caused by variations in sound pressure and variations in the speed of the sound particles in this porous medium result in absorptive damping.

Figure 2:
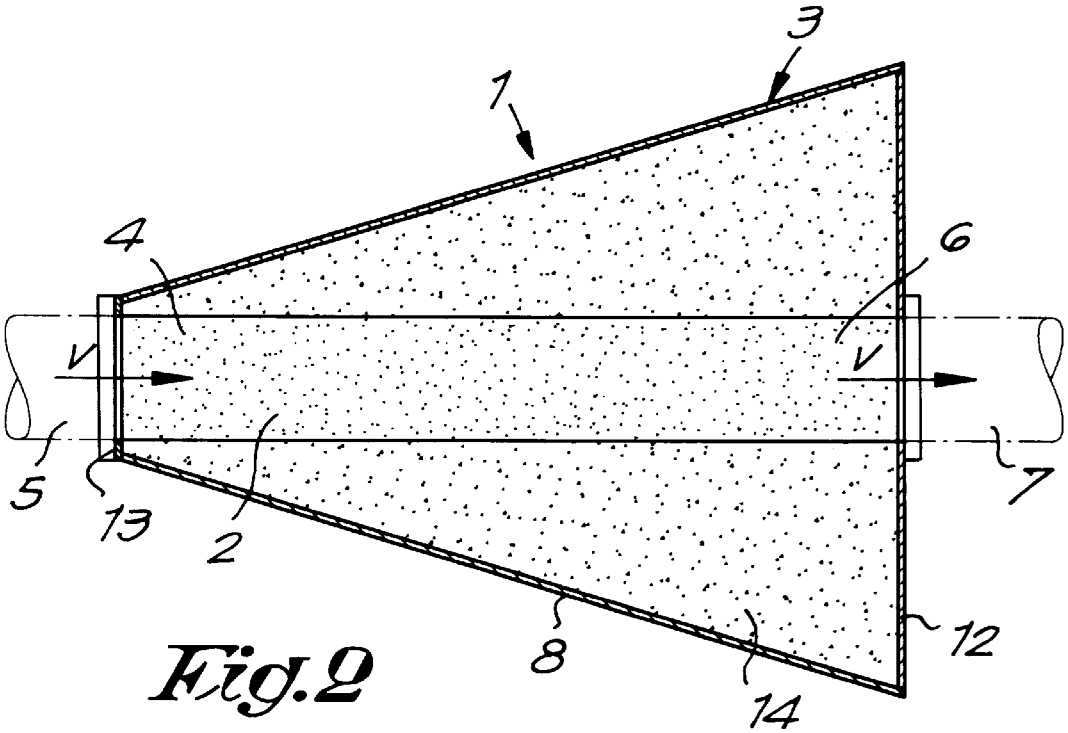
FIG. 2 shows a variant of to FIG. 1.

FIG. 2 shows an alternate embodiment in which, instead of using the tube 10, the protective layer 11 and the filling 9, use is made of a homogenous filling 14 consisting of a solidly cohering porous material that also defines central passage 2. By this is meant a material which is not made up of separate particles, such as for example fibres, and of which, as a consequence, no material particles can come loose.

For the filling 14, use can be made of a ceramic foam or a highly porous, sintered powder of stainless steel.

The present invention is by no means limited to the embodiments described as an example and represented in the figures; on the contrary, such an outlet piece can be made in various forms and dimensions while still remaining within the scope of the invention.

I claim:

1. An outlet piece for a compressor comprising:

a constant diameter central passage having an open inlet and an open outlet end for conducting a fluid medium containing pressure pulses in a longitudinal direction of flow from the inlet end to the outlet end;

a pulse damping body comprising sound absorbing material symmetrically surrounding and contiguous with the central passage from the inlet end to the outlet end and in fluid communication with the interior of the passage;

said damping body having a transverse dimension extending transversely of the passage that gradually increases along the flow direction of the passage so that the damping body has an increasing transverse thickness along the flow direction with the transverse dimension of the damping body adjacent the inlet end of the central passage corresponding substantially to the diameter of the central passage inlet end.

2. An outlet piece according to claim 1, wherein the pulse damping body is cone-shaped.

3. An outlet piece according to claim 1, wherein said sound-absorbing material comprises a fibrous mass.

4. An outlet piece according to claim 1, wherein said sound-absorbing material consists of material selected from the group including rock wool, glass wool, ceramic wool, basalt wool and stainless steel wool.

5. An outlet piece according to claim 1, including a porous, sound-transparent tubular wall surrounding said central passage.

6. An outlet piece according to claim 5, said wall consisting of a material selected from the group including fine-pore woven wire mesh filtering material; sintered, non-woven wire mesh; and sintered and reinforced non-woven wire mesh.

7. An outlet piece according to claim 6, including an air-permeable protective layer surrounding said wall.

8. An outlet piece according to claim 7, said protective layer consisting of a material selected from the group including a textile material and a non-woven material.

9. An outlet piece according to claim 1, wherein said sound-absorbing material comprises a solid, porous structure having a central opening that defines said central passage.

10. An outlet piece according to claim 9, wherein said porous structure consists of a material selected from the group including ceramic foam; metallic foam; a highly porous, sintered powder of stainless steel; and a sintered ceramic powder.

11. An outlet piece according to claim 1, wherein said damping body includes an outer sheet material jacket.

12. An outlet piece according to claim 1, including a compressor having an outlet connecting to the inlet of said passage.

13. An outlet piece according to claim 12, wherein said compressor is a screw-type compressor.

* * * * *